United States Patent [19]

Zaruba

[11] 3,931,775

[45] Jan. 13, 1976

[54] AUTOMATIC BUTTON FEEDER

[75] Inventor: Wenzel Zaruba, Totowa Borough, N.J.

[73] Assignee: Textol Systems, Inc., Carlstadt, N.J.

[22] Filed: Sept. 6, 1974

[21] Appl. No.: 503,574

[52] U.S. Cl. ..... 112/113

[51] Int. Cl.[2] ..... D05B 3/22

[58] Field of Search ..... 112/252, 104–113; 221/156, 159, 160, 163, 224, 267, 157, 164, 167, 171, 183, 186, 274, 270, 268

[56] References Cited

UNITED STATES PATENTS

| | | | |
|---|---|---|---|
| 3,483,833 | 12/1969 | Conner | 112/113 |
| 3,633,524 | 1/1972 | Hodgins et al. | 112/113 |
| 3,670,673 | 6/1972 | Jacobs et al. | 112/113 |

*Primary Examiner*—Geo. V. Larkin

*Attorney, Agent, or Firm*—Caesar, Rivise, Bernstein & Cohen

[57] ABSTRACT

An automatic button feeder is provided which comprises an orientation station for receiving buttons in sequence, a sewing station at which a button is sewn and an injecting arm for moving the button from the orientation station to the sewing station. The arm includes alignment pins at the end thereof which are used in combination with orientation means which align the openings of the buttons with the alignment pins. The feeder also includes pneumatic means for moving the arm which draws the arm under the orientation station. The button openings are aligned with the pins by the orientation means. The arm remains stationary after the button has been aligned until a button at the sewing station has been removed therefrom.

26 Claims, 17 Drawing Figures

AUTOMATIC BUTTON FEEDER

This invention relates generally to automatic button feeders and more particularly to an automatic button feeder which is primarily designed for use with an automatic garment indexer, but which also has application with a sewing machine in which the garment is manually positioned.

Prior automatic button feeders have primarily been designed for use where garments are manually fed underneath the head of a sewing machine. Accordingly, when placed in the environment of an automatic indexing machine which automatically moves a garment to predetermined positions, the prior automatic button feeders have failed to be satisfactory.

The prior devices have typically used solenoid valves for movement of the buttons from a feeder system to the sewing station. This means that the tolerances of the devices must be extremely fine in order to enable the solenoid to operate the injecting portion of the prior feeding system.

The prior automatic button feeders have also suffered from the fact the orientation means for aligning the button holes with the sewing portion of an automatic button hole sewing machine have been extremely complicated, require extremely fine tolerances and more often than not scratch and sometimes break the buttons being used. That is, the orientation means have typically utilized metal pins which are lowered or urged into the openings of the button to rotate the button to a specific orientation. The pins, when lowered onto the button, are not always aligned with the openings of the button and thereby scratch and mar the top surface of the button which is normally supported by a hard non-resilient surface.

Still another problem with prior button feeders is the lack of an adequate sensing means to determine when a button has not been adequately secured to a garment in order to stop the operation of the garment indexing machine. Moreover, in these prior button feeders when the thread is broken the button feeder continues to feed buttons until the indexing operation of the machine is stopped thereby causing buttons to be ejected onto the floor and thereby lost. Also, the garments are ejected without all of the buttons sewn thereon. This is not only expensive but is also very wasteful and can considerably increase the costs of an automatic button sewing operation.

It is therefore an object of this invention to overcome the aforementioned disadvantages.

Another object of this invention is to provide a new and improved automatic button feeder which has relatively few parts and is moved simply through pneumatic means.

Still another object of the invention is to provide a new and improved automatic button feeder which provides positive delivery of buttons despite the irregularities in thickness and diameter thereof.

Still another object of the invention is to provide buttons at a sewing station which are positively aligned with the holes of the needle.

Still another object of the invention is to provide a new and improved garment fastener sensing means which enables the sensing of whether a garment fastener has been suitably affixed to a garment prior to removal of the garment from the sewing station.

Yet another object of the invention is to provide a new and improved automatic button feeder which includes orientation means which prevent scarring and scratching of a button oriented thereby.

Still another object of the invention is to provide a new and improved automatic button feeder which includes sensing means for automatically stopping the operation of the device when the thread of the sewing machine has broken or a button has failed to be sewn to the garment.

These and other objects of the invention are achieved by providing an automatic button feeder which comprises an orientation station for receiving buttons in sequence, a sewing station at which a button is sewn, an injecting arm for moving the buttons from the orientation station to the sewing station, alignment means and means for moving the arm. The arm includes at least one upwardly extending pin. The alignment means aligns the openings of the buttons with the pins and means for moving the arm is provided for moving the arm under the orientation station whereby the button openings are aligned with the pins by the alignment means. The means for moving is stationary until a button at the sewing station is removed from the sewing station.

Other objects and many of the attendant advantages of this invention will be readily appreciated as the same becomes better understood by reference to the following detailed description when considered in connection with the accompanying drawings wherein.

Referring now in greater detail to the various figures of the drawings wherein like reference numerals refer to like parts, an automatic button feeder embodying the invention is shown generally at 20 in FIG. 1.

Figure 1:
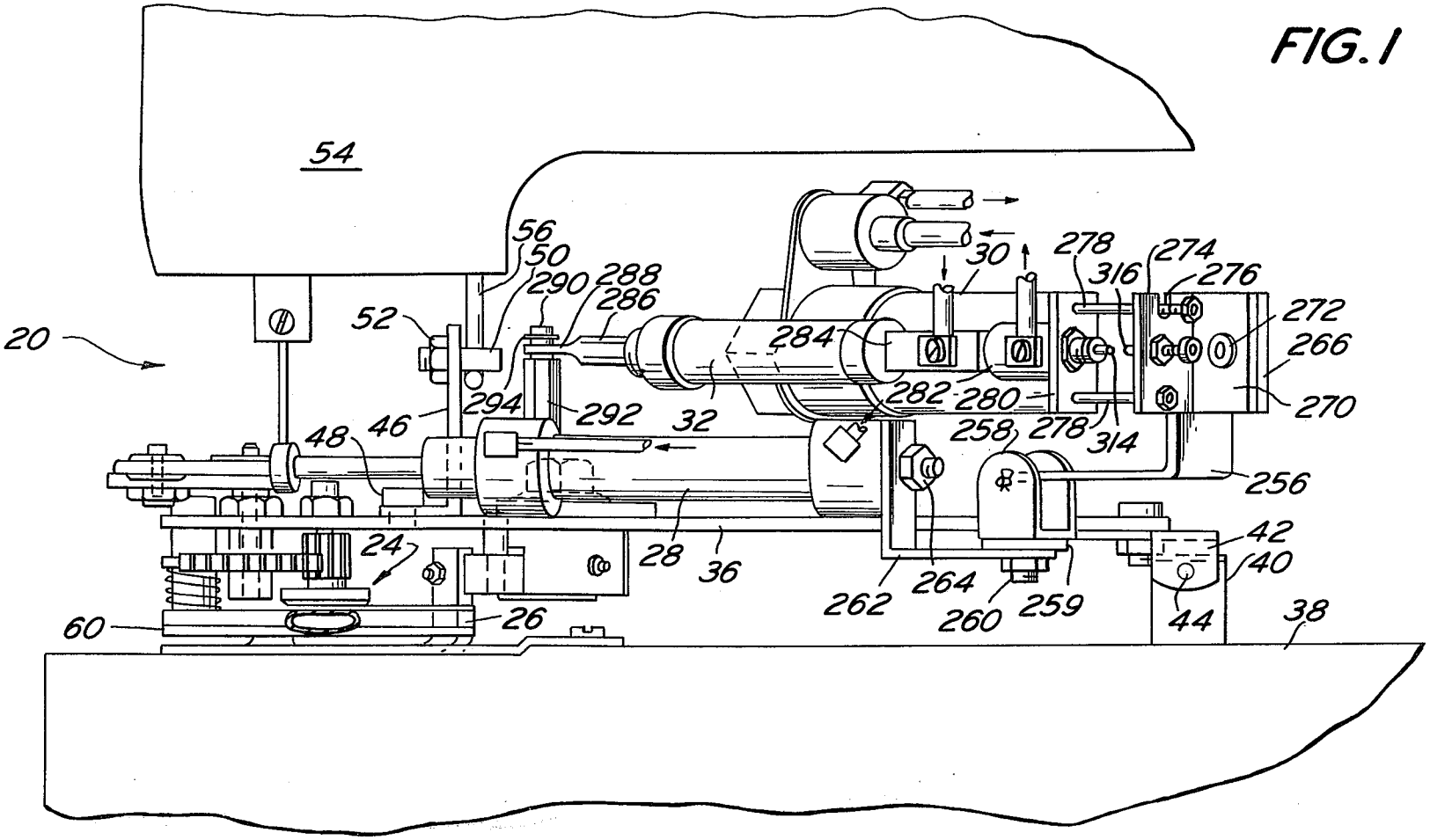
FIG. 1 is a side elevational view of a preferred automatic button feeder embodying the invention for use with an automatic garment indexing machine.
Figure 2:
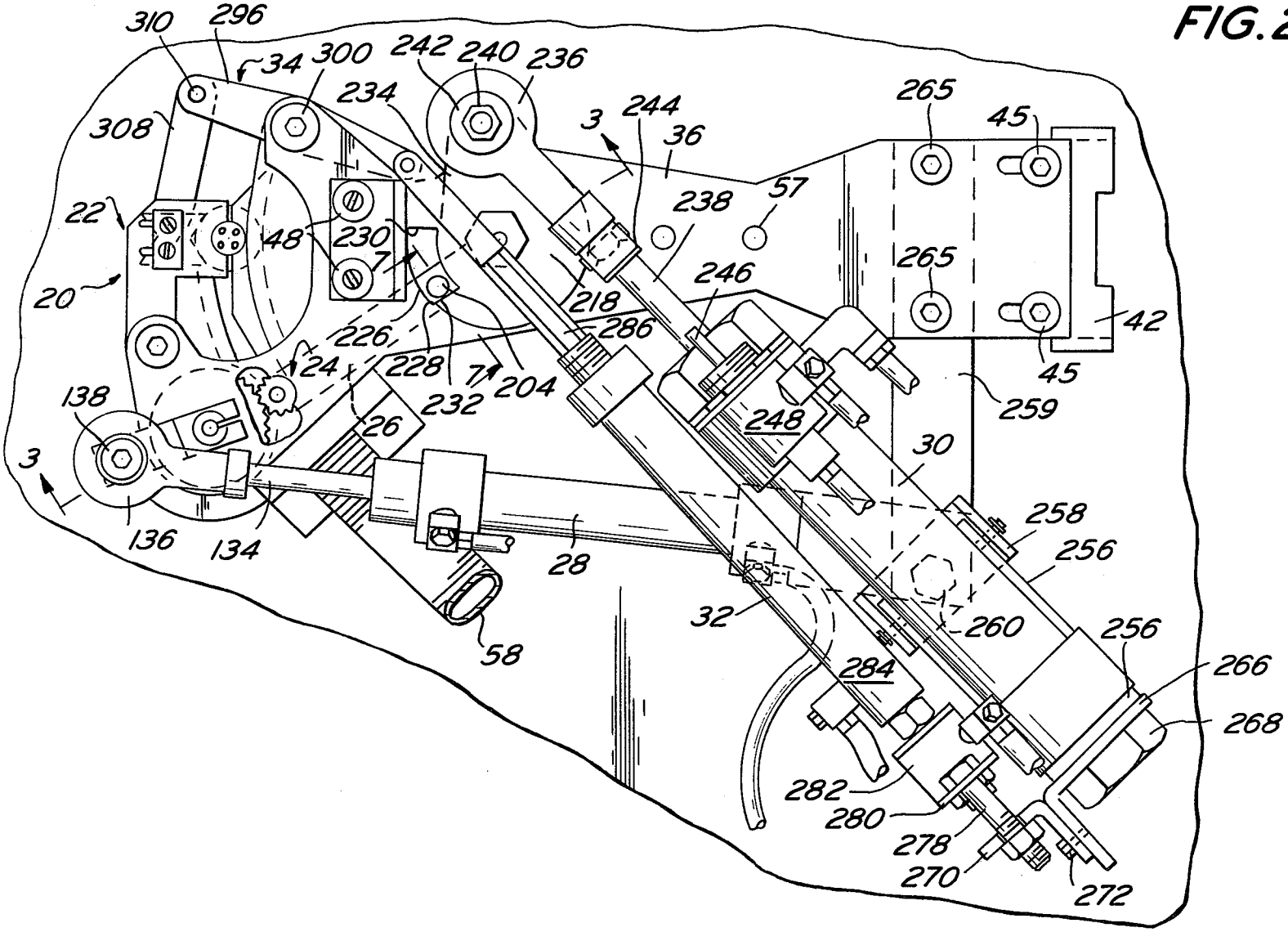
FIG. 2 is a top plan view thereof.

Referring to FIGS. 1 and 2, it can be seen that the automatic button feeder 20 basically comprises a sewing station 22, an orientation station 24, an injection arm 26, an orientation cylinder 28, an injection cylinder 30, a thread sensing cylinder 32, a thread sensor 34 and a main clamp bracket 36.

The various elements 22 through 34 are supported by the main clamp bracket 36. The main clamp bracket 36 is pivotably secured to the sewing machine table 38 by a bracket 40 and a bracket 42 which are pivotally secured together by a pin 44 to form a hinge. Main clamp bracket 36 is suitably secured to the bridging portion of bracket 42 by a pair of threaded fasteners 45 which extend through slotted openings in bracket 36 and are threadedly secured to bracket 42. The legs of bracket 42 each have an opening which are aligned with respect to each other and through which the pin 44 extends and is pivotally secured in an opening in bracket 40 which is suitably secured to the table 38 of the sewing machine.

An L-shaped bracket 46 is secured to the top surface of the main clamp bracket 36 via threaded fasteners 48. The bracket 46 includes a threaded opening through which a stem 52 having a threaded end is stationarily affixed by a nut 52 which is threadedly secured thereto.

The sewing machine head 54 includes a clamp hook 56 which depends from the sewing machine head and is L-shaped and hooks about the stem 50. The clamp hook 56 is movable vertically and supports one end of the automatic button feeding assembly with the rear end of the automatic button feeder pivotable about an supported by pin 44.

It should be understood that the sewing machine 54 is an automatic button sewing machine which includes a spring clamp (not shown) which is connected to the main clamp bracket 36 at opening 57 and biases the main clamp bracket 36 downwardly so that a button held in the sewing station 22 is pressed against the top of a garment when the button is sewn thereto. After a button sewing operation has been completed, the sewing machine clamp 56 is lifted and thereby causes the entire assembly to be moved off of the garment so that the garment can be pulled out of the sewing machine or, as in the instant case wherein a garment indexing system is used, the button can then be moved by the indexing apparatus. A typical sewing machine including these features is a Singer 114-37 and an indexing mechanism for moving a garment that is preferred in this system is the TEXTOMATIC indexer made by Textol Systems, Inc.

The orientation station 24 is located adjacent a track 58 which is in turn connected to a vibrating button feeder. A preferred vibrating button feeder is made by Syntron and the feeder utilizes a spiral bowl which is constantly vibrated to cause a sequence of buttons to be fed to the track 58. The buttons that are upside down are automatically caused to drop to the bottom of the spiral bowl prior to being inserted into the track 58 and provided to the automatic button feeder. Such a vibrating device is well known and forms no part of the instant invention.

A typical vibrating button feeder which may also be used is shown in the patent to W. B. Hopkins U.S. Pat. No. 3,494,311 issued on Feb. 10, 1970.

Basically, buttons are provided via track 58 to the orientation station 24. The injection arm 26 moves a button from the orientation station 24 to the sewing station 22 when it is moved by the injection cylinder 30. When the arm 24 returns to the orientation station 24, cylinder 28 causes the rotation of the button until it is aligned with pins provided in the arm 26 so that the button will be in the proper orientation when it is provided to the sewing station 22.

Figure 3:
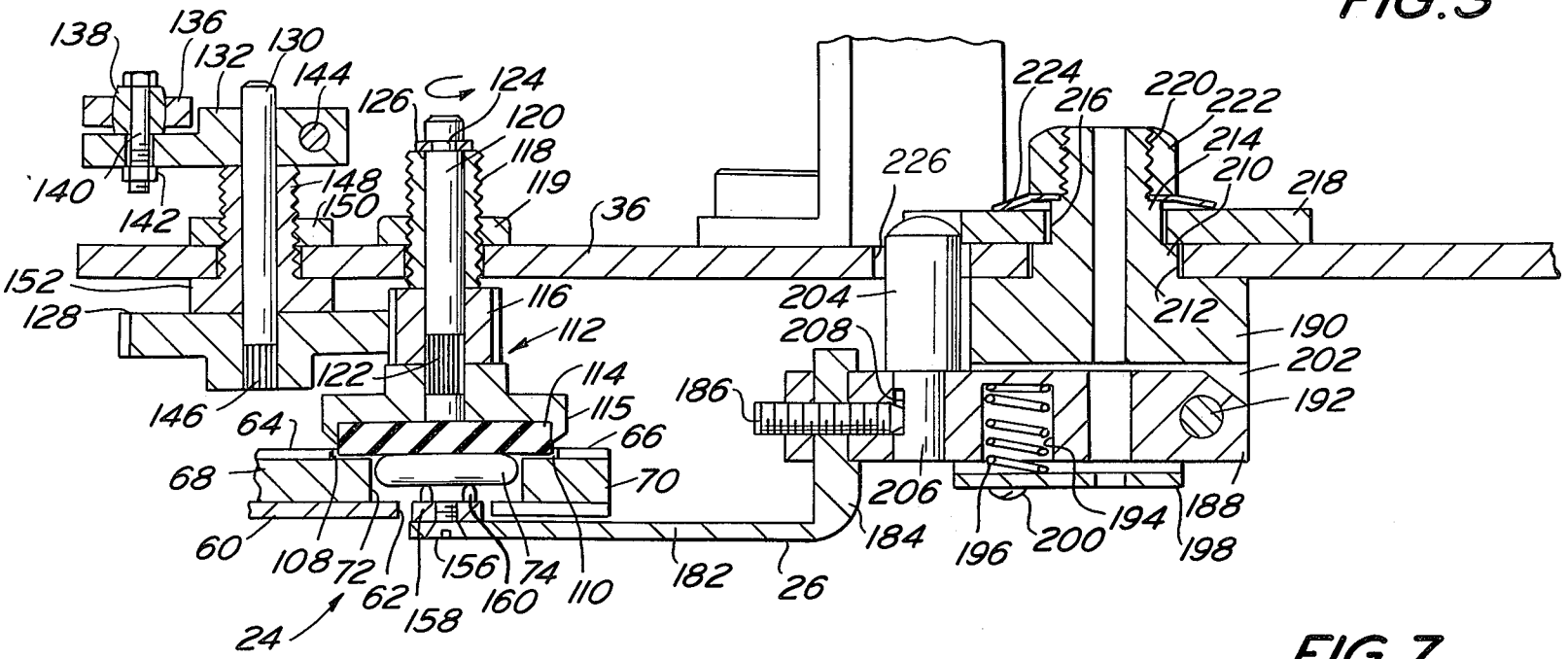
FIG. 3 is an enlarged sectional view taken along the line 3—3 in FIG. 2.
Figure 4:
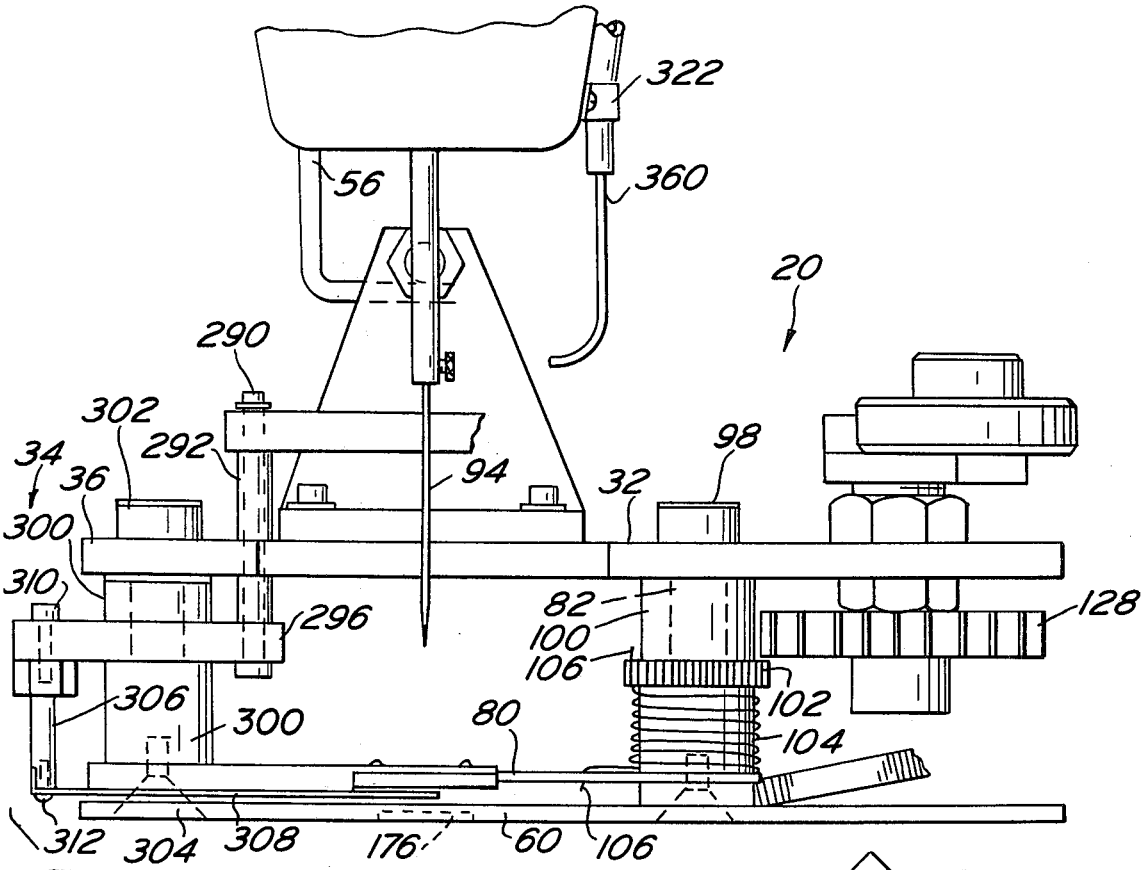
FIG. 4 is an enlarged front elevational view of the automatic button feeder.
Figure 5:
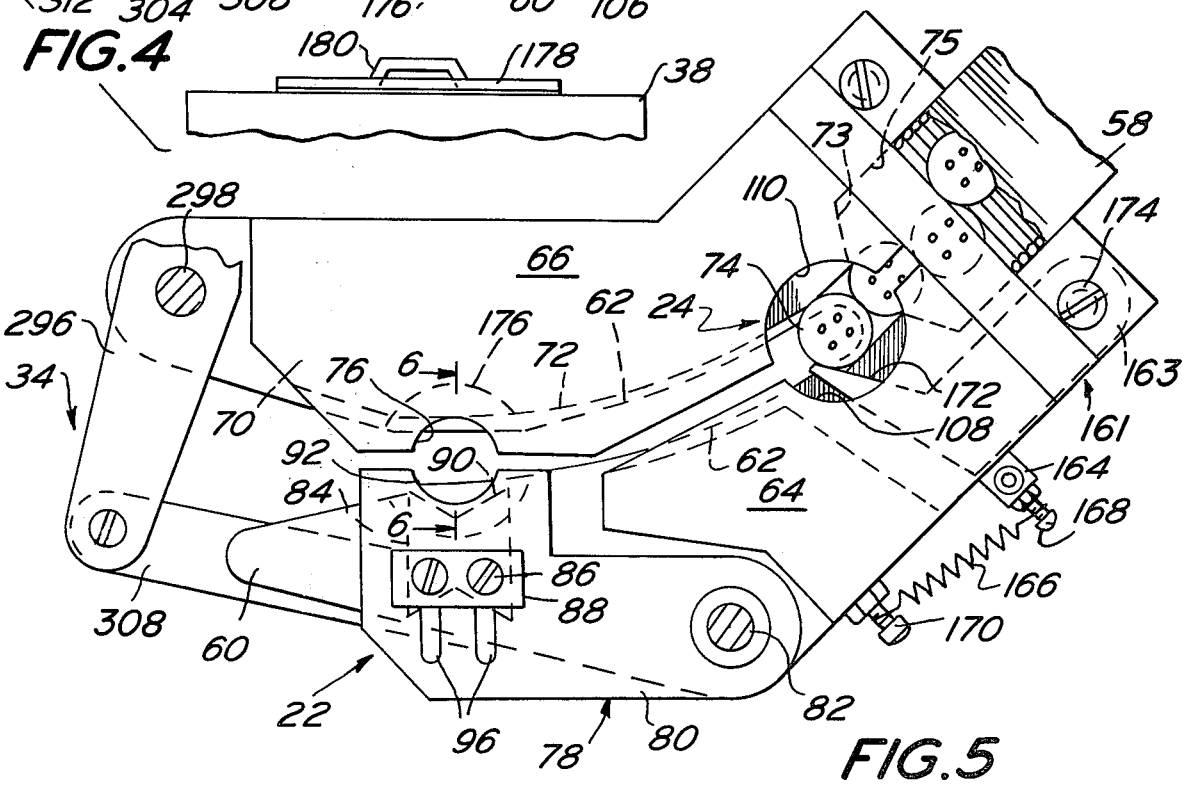
FIG. 5 is an enlarged top plan view of orientation and sewing stations of the automatic button feeder embodying the invention.

The sewing station and orientation station 24 are best seen in FIGS. 4 and 5. The sewing station 22 and orientation station 24 are provided on a mounting plate 60. Mounting plate 60 includes an elongated slot 62 which extends from the leftmost end as seen in FIG. 4 to a point adjacent the rightmost end of the plate 60. Slot 62 is widest at the leftmost end thereof and is narrow through the remaining portion thereof. A pair of cover plates 64 and 66 are secured to the mounting plate 60 but spaced therefrom by a pair of spacer plates 68 and 70, as best seen in FIG. 3. It should be noted that the spacer plates 68 and 70 are also spaced laterally from each other and thereby form a track 72 within which a button 74 is guided to the sewing station.

As best seen in FIG. 5, the track 72 is flared at 73 to a maximum width at 75 to receive wire track 58, which is in turn connected to the vibratory feeder. The wire track 58 is held by a press fit within the widened portion 75 of track 72.

Figure 6:
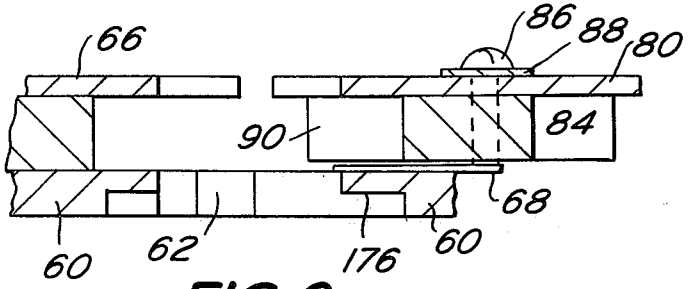
FIG. 6 is an enlarged section view taken along the line 6—6 in FIG. 5.

As best seen in FIG. 5, the cover plate 66 includes a semi-circular notch 76 which is disposed at the sewing station 22. Mounted adjacent the cover plate 64 is a button clamp 78 which comprises a pivotable plate 80 which is pivotably secured about post 82 and, as seen in FIG. 6, has secured thereto a button holding block 84. The button holding block 84 is secured to the pivotable plate 80 by a pair of threaded fasteners 86 which extend through a strap washer 88 provided on the top surface of plate 80. The button holding block 84 includes a V-shaped notch 90 in which the button is ultimately secured when placed in the sewing station. The V-shaped notch 90 is provided below a semi-circular notch 92 in the plate 80 which provides with notch 76 an opening through which the needle 94 of the sewing machine passes in order to sew a button to a garment. The plate 80 also includes a pair of elongated slots 96 through which the threaded fasteners pass for securing the block 84 to plate 80.

As best seen in FIG. 4, post 82 depends from the main clamp bracket 86 and is secured thereto by a threaded fastener 98. A sleeve 100 is provided at the top of post 82 and includes a knurled annular flange 102 which is provided to enable adjustment of the tension of a spring 104 which is mounted about the post between the sleeve 100 and the top of plate 80. The sleeve 100 tightly embraces the post 82 and is rotated with respect thereto to adjust the tension of spring 104. The spring 104 has a first end loop 106 secured in an opening in the flange 102 and the other end is looped about the plate 80 to urge the plate 80 towards cover plate 66. The button clamp 78 is thus pivotably secured about post 82 and is spring loaded to be urged towards the cover plate 66. The button holding block 84 extends slightly into the button track 72, but is moved thereout when a button 74 is moved by the injection arm to the sewing station within the opening provided by notches 76 and 90. When the button is located directly below the opening provided by notches 76 and 90, the button holding block is urged against the button and maintains the button 74 between the spacer plate 70 and the V-shaped notch in the button holding block 84. As will hereinafter be seen, the tension of the spring 104 is adjusted to assure that the pressure holding the button between the button holding block 84 and spacer plate 70 is great enough to enable the injection arm to be released from the button and then returned to the orientation station.

The orientation station 24 is defined by a circular opening in the cover plate 64 and 66 which are formed by a pair of semi-circular notches 108 and 110 which are provided in cover plates 64 and 66, respectively.

The opening provided by semi-circular notches 108 and 110 are provided directly below an orientation device 112. The orientation device 112 includes a circular pad 114, a pad holder 115, a pinion 116, a threaded sleeve 118 and a rotatable shaft 120. The orientation device is pivotably secured to the main clamp bracket 36 by the threaded sleeve 118 which has a nut 119 threadedly engaged to the outermost surface thereof. The shaft 120 extends through the sleeve 118 and is rotatable therein but is fixedly secured by a knurled portion 122 which is press fit within the pinion 116 and the pad holder 115. The pad 114 is preferably comprised of a resilient compressible material such as rubber or a soft thermoplastic and is preferably adhesively secured within pad 115. The shaft 120 includes an annular groove 124 adjacent its uppermost end in which a split spring 126 is provided to prevent the shaft 120 from slipping downwardly in the sleeve 118.

The orientation device 112 is rotatable about shaft 120 thereby causing the pad 114 to rotate the button 74 disposed therebeneath. The orientation device is linked via a gear 128, post 130 and link 132 to the piston rod 134 of the orientation cylinder 28.

As best seen in FIG. 2, the piston rod 134 has a connector 136 at the end thereof which, as best seen in FIG. 3, has an opening for receiving a collar 138 having an arcuate convex outer surface. The collar 138 is rotatable within the complementary concave opening in connector 136 and is provided about the shank of a threaded connector 140. The threaded connector 140 extends through an opening in link 132 and is secured thereto by a nut 142. Thus, there is provided a pivotable linkage between the connector 136 and link 132. Link 132 includes a split end with an opening passing transversely therethrough for the receipt of a threaded fastener 144 to enable tightening of the opening through which post 130 passes to secure post 130 to the link 132. The post 130 is press fit to the gear 128 at its knurled end 146. The teeth of gear 128 engage the teeth of pinion 116. The ratio of teeth of gear 128 to pinion 116 is 4:1. Thus, the 90° rotation of gear 128 by the stroke of rod 134 causes a complete revolution of pinion 116 and pad 114 rotated thereby.

The post 130 extends through a threaded sleeve 148 which extends vertically through and is threadedly secured to bracket 36 and is tightened thereto via a nut 150. The threaded sleeve 148 includes an annular flange 152 which acts to space the gear 128 from the bracket 36. The shaft 130 is thus rotatable within the sleeve 148 to rotate gear 128 which in turn rotates pinion 116 since the teeth of gear 128 and pinion 116 are enmeshed. Thus, referring to FIG. 2, when the rod 134 of cylinder 28 is drawn within or pushed outwardly of the cylinder 28 it causes rotation of the pad holder 115 via the linkage comprising the link 132, rod 130, gear 128, pinion 116 and pad holder 115. As set forth above, the pad 114 extends within the opening formed by notches 108 and 110 and bears upon the top surface of a button 74.

The button 74 is thus contacted on its uppermost and thus visible surface by a soft pad which is used for rotating the button.

As best seen in FIG. 3, the injection arm 26 is provided below the mounting plate 60.

Figure 8B:
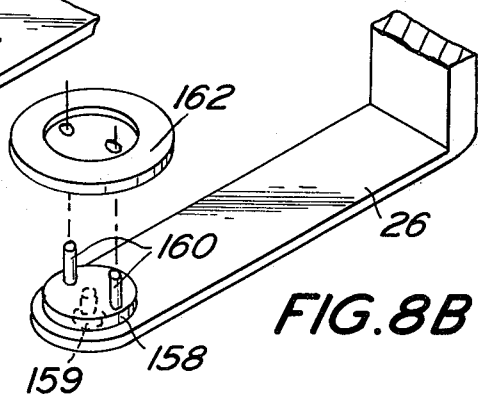
FIG. 8B is an enlarged exploded perspective view of a two hole button and the end of the injecting arm having a pair of pins for aligning a two hole button.
Figure 8A:
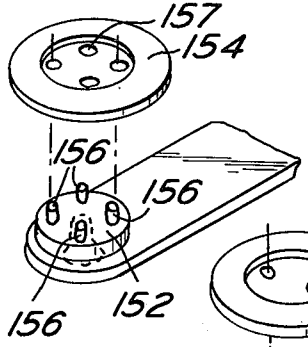
FIG. 8A is an enlarged exploded perspective view of a four hole button and the end of a injecting arm having a plurality of pins for aligning a four hole button.

The injection arm is best seen in FIGS. 8A and 8B wherein alternate ends are shown for use with either four hole or two hole buttons. That is, in FIG. 8A, an injection arm 26 includes a boss 152 which includes four pins 156 which are positioned to enable the alignment of the button holes with the sewing needle when the button is disposed within the sewing station during a button sewing operation. A button 154 having openings 157 is provided above the boss 152 in FIG. 8A to a show the alignment of the button openings with the pin when the button is properly oriented by the pad 114. An alternate embodiment of the end of arm 26 is shown in FIG. 8B wherein a boss 158 is provided with a pair of pins 160 which are used for a two hole button 162. It should be understood, however, that an arm such as that shown in FIG. 8B may be used not only for two hole buttons, but also for four hole buttons. However, the boss 158 must be aligned differently for two and four hole buttons. A bead is provided on the bottom surface of the boss which interfits with one of a pair of recesses in the top surface of arm 26. Each recess aligns the pins for either two or four hole buttons.

The injection arm 26 shown in FIG. 3 is preferably of the type shown in FIG. 8B having a pair of pins 160 which are secured to boss 158 which is in turn secured to the arm 26 via threaded fastener 159. The boss 158 extends up through the slot 62 provided in the mounting plate 60 and the pins connected thereto abut the bottom of button 74. When the button 74 is rotated by the pad 114, the button holes are aligned with the pins 160 whereupon the button drops to the top surface of boss 158 and thereby prevents any further spinning of the button 74. As will hereinafter be seen, the injection arm 26 is urged upwardly at the orientation station 24 so that the pins 160 bear against the bottom surface of the button 74 so that the pins are injected into the openings as soon as there is alignment between the openings and the pins.

The orientation station further includes a spring loaded stopping means 161. The stop means is provided in track 72 which receives a sequence of buttons from wire track 58. The stop means comprises a stop plate 163 having an L-shaped tab 164 and a spring 166. The spring 166 is secured at one end to a threaded fastener 168 which is secured to the L-shaped tab 164 of stop plate 163. The other end of spring 166 is connected to a threaded fastener 170 which is secured in turn to the lateral edge of spacer plate 68. The stop plate 163 further includes a laterally extending finger 172, the end of which extends into the track 72 for the buttons 74.

The stop plate 163 is pivotably secured about the shaft of a threaded fastener 174 which is threadedly secured in the cover plate 64 and the mounting plate 60. Fastener 174 with fastener 175 act to secure the cover plates 64 and 66 to the mounting plage 60. The stop plate is spring loaded by spring 166 to cause the finger 172 to extend in the track 72 to stop the buttons fed via the track 58 from the vibrating feeder. When the injection arm draws the button 74 to the sewing station, the finger 172 is urged out of the way and snaps back to prevent the next button from following until it is moved by the injection arm during the next button feed.

As best seen in FIGS. 5 and 6, the mounting plate 60 includes a cylindrical recess 176 in the lowermost surface thereof. As seen in FIG. 4, the sewing machine table 38 has mounted directly below the needle of the sewing machine head a sewing plate having a frustoconical projection 180 which fits within the cylindrical recess 176 in the lowermost surface of the mounting plate 60 of the automatic button feeder 20. The garment that is used by the machine operator is placed between the sewing plate 178 and the bottom of the mounting plate 60. The entire automatic button feeding assembly 20 is then lowered so that recess 176 is pressed over the projection 180 and the button is then sewn to the garment. When the button is completely sewn to the garment the entire assembly 20 is lifted up by the clamp lifting hook 56 of the sewing machine.

The injection arm 26 is best seen in FIG. 3. Basically the injection arm comprises an L-shaped member having a flat horizontally disposed leg 182 and a thicker upstanding integral leg 184. As set forth above, a boss having a pair of pins 160 is connected at the other end of leg 182. Leg 184 of the injection arm 26 is connected via a threaded fastener 186 to an arm bracket 188 which is in turn secured to a pivot holder 190. The arm bracket 188 is pivotably secured to the pivot holder 190 about a horizontally disposed pin 192. The arm bracket 188 includes a vertically extending cylindrical recess 194 in its lowermost surface in which a spring 196 is mounted. The spring is maintained in place via a horizontally disposed plate 198 which is secured by a threaded fastener 200 to the bottom of the pivot holder 190. As best seen in FIG. 3, the pivot holder 190 includes a vertically disposed slot 202 in which the arm bracket 188 is pivotably mounted.

A lift pin 204 is provided which has a reduced portion 206 which fits within a vertically extending opening provided therefor in the arm bracket 188. The reduced portion 206 of the lift pin 204 includes a recess 208 within which the end of fastener 186 is inserted to prevent removal of the lift pin 204.

The pivot holder 190 is generally cylindrical and includes a reduced cylindrical portion 210 which extends through opening 212 of the main clamp bracket 36. Integral with and projecting upwardly from reduced portion 210 is a still further reduced portion 214. Reduced portion 214 extends through an opening 216 in a lift disc 218. The reduced portion 214 further includes a threaded portion 220 which has threadedly secured thereto a nut 222. Provided between nut 222 and lift disc 218 is an annular spring washer 224 which is telescoped over portion 214 of the pivot holder 190.

As best seen in FIG. 2, the pin 204 extends up through an arcuate slot 226 in bracket 36. Slot 226 is concentric with the opening 216 through which portion 210 of the pivot holder extends. It should be understood that the pivot holder 190 rotates within opening 212 of bracket 36. The extent of movement of the pivot holder 190 about its vertical axis is limited by the length of slot 226.

That is, as shown in FIG. 2, the pin 204 is abutting end wall 228 of slot 226. In this position, the pivot holder 190 is at a first limit with the arm 26 extending directly below the orientation station 24. When the pivot holder 190 is rotated to the position that pin 204 abuts end wall 230 of slot 226, arm 26 is moved to a position directly below the sewing station 22.

As best seen in FIG. 2, the lift disc 218 is generally circular with a portion of its periphery removed to form a shoulder 232. The lift disc 218 also extends laterally at 234. The lateral extension 234 of lift disc 218 is pivotally secured to the connector 236 of a rod 238 of the injection cylinder via a threaded fastener 240 which has a collar 242 similar to collar 138 which is rotatably mounted in connector 236 and which is telescoped over the shank of fastener 240.

Flange 244 is secured to rod 238 adjacent the connector 236. The flange 244 is best seen in FIG. 2 and extends vertically upward and is aligned with and adapted to abut the stem 246 of a valve 248 which is mounted on injection cylinder 30. When the rod 238 of injection cylinder 30 moves inwardly or outwardly of the cylinder 30, it causes rotation of the lift disc 218.

When the rod 238 is moved inwardly of cylinder 30 it causes disc 218 to rotate clock-wise around its vertical axis, as seen in FIG. 2, which thereby causes shoulder 232 to abut pin 204 and thereby rotate pivot holder 190 until the injection arm 26 is moved directly below the sewing station of the automatic button feeder.

Figure 7:
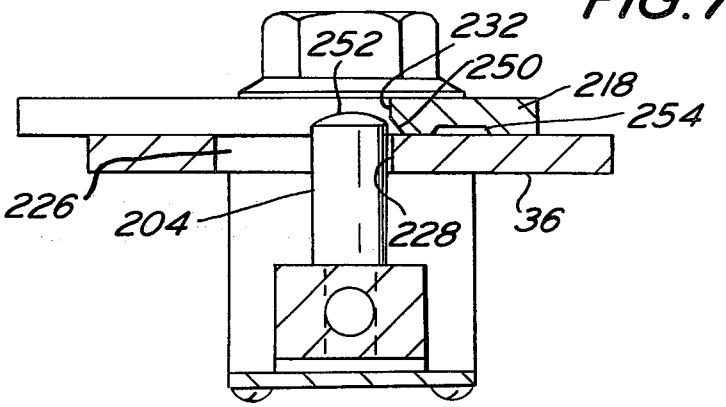
FIG. 7 is an enlarged sectional view taken along the line 7—7 in FIG. 2.

The arm 26 stops at the sewing station when pin 204 abuts wall 230 of slot 226. As best seen in FIG. 7, shoulder 232 of the lift disc 218 includes a chamfered portion 250 which extends up to the hemispherical top surface 252 of the pin 204. Thus, when pin 204 abuts the end wall 230 of slot 226, the lift disc 218 rides over the top surface 252 of the lift pin 204 thereby forcing downwardly the pin 204 and thereby causing the arm bracket 188 to be pivoted about the pin 192 and thereby lowering the arm 26.

Arm 26 has a button engaged on pins 160 when it is disposed in the orientation station. When the button is moved to the sewing station, the button is clamped in place by the button clamp. At the sewing station the arm 22 is then removed from the button when it is lowered by the action of the lift disc passing over the pin 204. At the end of the movement of the rod 238 within the injection cylinder 30, the flange 244 abuts the stem 246 of valve 248 which, as will hereinafter be seen, causes the rod 238 to be ejected from the cylinder and thereby cause a counter clock-wise rotation of the lift disc 218 about its vertical axis.

As seen in FIG. 7, the lowermost surface of the lift disc 218 includes a recess 254 which is aligned with the pin 204. After the lift disc 218 rides over pin 204 the top surface 252 of pin 204 lodges in recess 254. When the lift disc 218 is roatated counter clock-wise as seen in FIG. 2, the pin 204 moves with the disc 218 and thereby rotates the pivot holder 190 counter clock-wise about its vertical axis and thereby causes the injection arm 26 to be moved back to the orientation station. As soon as the orientation station is reached, the pin 204 abuts the end wall 228 of the slot 226 and thereby causes the pivot holder 190 to stop rotating.

The lift disc 218, however, continues to rotate counter clock-wise and thereby slips off the top surface of pin 206. The pin 204 is caused to rise in view of the fact that the spring 196 biases upwardly the bracket 188 about pin 192. This also causes the arm 26 which is connected to bracket 188 to rise and thereby causes the pins 160 to abut the lowermost surface of the next button. At the same time, the pad 114 is started rotating by the orientation cylinder which causes the button holes to be aligned with pins 160 and thereby enables the arm to be moved to its uppermost extent engaging the button.

As best seen in FIGS. 1 and 2, the injection cylinder 30 is supported by an L-shaped bracket 256 which is pivotably secured to a U-shaped bracket 258. U-shaped bracket 258 is secured to a cross bar 259 via a threaded fastener 260 which also extends through a leg of an L-shaped bracket 262 which supports orientation cylinder 28. The other leg of L-shaped bracket 262 is connected to the cylinder 28 via a suitable fastener 264.

Cross bar 259 is supported by and secured to the main clamp bracket by a pair of threaded fasteners 265. The fasteners extend through openings in the bracket and the bar to secure them together.

The leg of L-shaped bracket 256 is connected between the leg of a second L-shaped bracket 266 and cylinder 30 by fastener 268 to the injection cylinder 30. The other leg of L-shaped bracket 266 is connected to another L-shaped bracket 270 via a threaded fastener 272. Leg 274 of bracket 270 includes a pair of U-shaped slots through which a pair of elongated threaded rods 278 extend.

As best seen in FIG. 2, the rods 278 are connected to a flange 280 of valve 282. Valve 282 is connected via manifold 284 to thread sensing cylinder 32. Thread sensing cylinder 32 includes a rod 286 which includes a flat end 288 having an opening therein for receipt of the reduced portion 290 of a linking rod 292. The reduced portion 290 of the rod 292 includes an annular recess in which a split spring 294 is provided to prevent removal of the rod 286 from the top of rod 292.

As best seen in FIG. 4, the linking rod 292 is connected to a lever 296 of the thread sensor 34. Lever 296 has an opening at the center thereof and it is rotatably mounted about a shaft 298 which extends vertically between the main clamp bracket 36 and the support plate 60. A pair of spacing collars 300 are provided about the lever 296 to space it appropriately from the clamp bracket 36 and the supporting plate 60. The shaft 298 extending through lever 296 is secured at each end by fasteners 302 and 304, respectively. The lever member 296 is fixedly connected via a linking rod 306 to a finger 308. The rod 306 is secured to lever 296 by a fastener 310 and to the finger 308 by fastener 312.

When lever 296 is rotated counter clock-wise as shown in FIG. 2, the finger 308 is passed between the mounting plate 60 and the pivotable plate 80. If a button has been sewn to the garment, the finger 308 abuts the threads and thereby prevents further counter clockwise movement of lever 296. If thread is not abutted, which indicates that either the thread has been broken or another malfunction of the machine has prevented securement of the button to the garment, the finger 308 continues to move past the position of the button.

When a button has been properly sewn, it is sensed by a stem 314 of valve 282. That is, mounted on a leg of L-shaped bracket 274 is a screw 316 which extends through the leg 274 in alignment with the sensor 34. When it is determined whether a button has been sewn properly, a pulse of air is provided via manifold 284 to the cylinder 32 which causes the emission of the rod 286 thereof. The emission of rod 286 causes the rotation of lever 296 and thereby the movement of finger 308 beneath the button at the sewing station.

If no thread is provided between the button and the garment, the finger 308 continues to move and pass by and the rod 286 of the cylinder 32 continues to its outermost extent. When a button is properly sewn to a garment, the finger 308 abuts the thread between the button and the garment which causes the lever 296 to stop rotating which in turn causes the cylinder 32 to back up as the air pressure builds up within the cylinder and thus causes the cylinder to move off rod 286 and causes flange 280 to approach bracket 274 and thereby causes the stem 314 of valve 282 to abut the screw 316. As will hereinafter be seen, the depression of stem 314 within valve 282 causes the detection of a properly sewn button which enables the next button to be moved from the orientation station to the sewing station of the automatic button feeder.

As seen in FIG. 2, the angle between the axis of rod 286 and the longitudinal axis of lever 296 is substantially greater than 90°. Thus, there is a large mechanical advantage as the finger 308 abuts the thread between the garment and the button to enable the backing off of hydraulic cylinder 32. The resistance to rotation of the lever is, of course, very small when no thread is abutted by the finger 308 and therefor the cylinder is not moved rearwardly unless a button is properly sewn.

It should be noted that the sensor 34 has general application to forms of garment fasteners other than buttons such as snap fasteners. The sensor 34 can thus be used to determine whether snaps have been affixed to garments where a garment indexer is utilized to automate affixing of a plurality of snaps to a garment.

Figure 9:
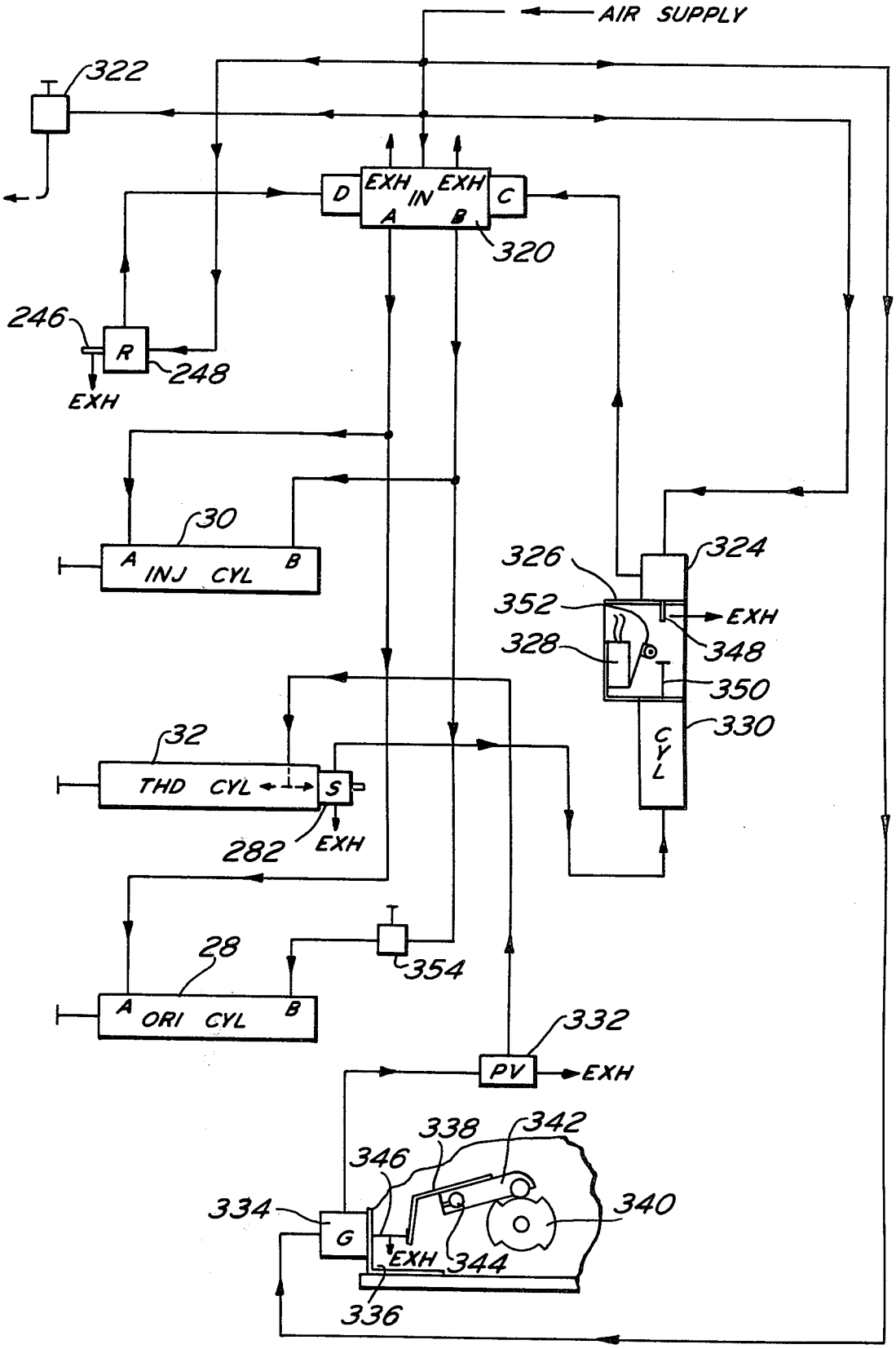
FIG. 9 is a schematic block diagram of the fluid control system of the automatic button feeder embodying the invention.

The control system for the automatic button feeder is shown in schematic block diagram form in FIG. 9. The control system is comprised of a fluid logic system which includes, in addition to orientation cylinder 28, injection cylinder 30, thread sensing cylinder 32, valve 248 and valve 282, a four way double pilot valve 320, a bleeder valve 322, valve 324, air cylinder 330, a valve 324, a pulse valve 332 and a value 334. Valve 334 is supported by an L-shaped bracket 336 which is mounted adjacent a bracket 338 which is controlled by a cam 340 which is responsive to the sewing machine cycle. The cam 340 is mounted adjacent a cam follower 342 which is pivotably connected about pin 344. Bracket 348 is secured to the cam follower 342. Each time the cam follower 342 follows a depression in the periphery of cam 340, the bracket 338 depresses stem 346 of valve 334 and thereby enables the passage of air through valve 334.

A supporting bracket 326 is provided which supports the valve 324 and cylinder 330. Valve 340 includes a stem 348 which is aligned with rod 350 of cylinder 330. When the rod 350 is completely extended it depresses the stem 348 causing the flow of fluid through valve 324. A microswitch 328 is also secured to bracket 326. When rod 350 moves out of cylinder 330 it causes the arm 352 of microswitch 328 to be depressed and thereby closes a circuit which is provided to the garment indexing apparatus, which as will hereinafter be seen, enables the garment to be moved to its next position for sewing the buttons. The rod 350 of cylinder 330 is spring based to return to its inner position within cylinder 330 after pulse of air pressure to cylinder 330 is terminated.

The four way double pilot valve 320 has a pair of exit ports A and B and a pair of pilots C and D. In its normal operation the four way double pilot valve has air flowing into its inlet port (IN) from the air supply and out port B. As soon as air pressure is provided to pilot C, the flow of air goes from the inlet port of valve 320 out port A. In addition to the four way pilot valve, the air supply is connected to bleeder valve 322 which acts as a thread blower to blow the thread off the garment. The bleeder valve 322 is best seen in FIG. 4 wherein it is connected to a hollow stem 360 which causes a steady stream of air to be blown at the thread to keep it off the garment.

The air supply is provided from the indexing apparatus. The pressure of the air supply is preferably 60 psi.

The air supply is thus connected via fluid lines to the inlet port of valve 320, to bleeder valve 322, and also to the R valve 248, the G valve 334 and valve 324. The output of valve 248 is connected via a fluid line to the input of the pilot D of valve 320. The valve 248 conducts fluid from the air supply to pilot D of valve 320 when the valve stem 246 thereof is depressed. Similarly, valve 324 conducts fluid therethrough when valve stem 348 is depressed and the output is connected to pilot C of four way valve 320. The input of cylinder 330 is connected to the output of the S valve 282. The output of valve 334 is connected to the pulse valve 332. The output of pulse valve 332 is connected to the manifold input of cylinder 32. Port A of the four way pilot valve 320 is connected to the A input of injection cylinder 30 and the A input of the orientation cylinder 28. The B port of the four way pilot valve 320 is connected to the B port of the injection cylinder 30 and to the orientation cylinder 28 via flow regulator 354.

In operation, the flow of air through the four way pilot valve is normally out the B port and thereby causes the rods of injection cylinder 30 and orientation cylinder 28 to be at their outermost point. When the sewing cycle of an automatic sewing machine is completed, the cam follower 342 falls into the depression in the surface of cam 340 and thereby causes the depression of stem 346 within valve 334. Valve 334 thereby conducts air pressure to pulse valve 332 which causes a pulse of air to be provided to the thread sensing cylinder 32.

When the thread sensing cylinder emits the rod 286 and a thread is sensed between a button and a garment, the stem of valve 282 is despressed as set forth above, causing the remaining pulse of air to be provided from the output of the S valve to the input of cylinder 330. When cylinder 330 receives the air pulse, the rod 350 is urged towards stem 348 and depresses stem 348. As the rod 350 passes the microswitch 328, a closed circuit is provided to the indexing apparatus which causes the indexer to move the garment with the previous button attached thereto.

The depression of stem 348 causes the valve 324 to conduit air pressure to the pilot C of valve 320 thereby causing the A port thereof to conduct air to the A inputs of the injection cylinder and the orientation cylinder.

The rod of injection cylinder 30 is moved into the cylinder 30 by pressure at inlet Port A and causes the injection arm to move the next button into the sewing station 22 where it is clamped inplace below the sewing needle. The rod of the orientation cylinder is also moved inwardly by the air pressure at port A.

When the rod 238 completes its movement into cylinder 30, the flange 234 abuts the stem 246 of valve 248, thereby causing conduction of the air supply via valve 248 to the pilot D of valve 320 and thereby shifts the flow of the air supply to port B again. The shifting of the air supply to port B causes the rods of injection cylinders 30 and 28 to be emitted from the cylinders.

The injection arm 26 is returned to the orientation station and is pressed up against the next button in the button track. The emission of the rod 134 of the orientation cylinder 28 causes the rotation of pad 114 thereabove, and thereby orients the button with respect to the pins provided on the injection arm. It should be noted that the flow regulator 354 causes a delay of the movement of the rod in orientation cylinder 28 with respect to the rod of injection cylinder 30. The movement of the injection arm to the orientation station is therefore completed before the rotation of the pad 114 is completed.

The automatic sewing apparatus then sews the button in the sewing station to the garment whereupon the completion of the sewing cycle causes the stem 346 of valve 334 to be again depressed and the logic sequence repeated. The indexing system is provided with a cutoff which prevents further movement of the indexer after a predetermined number of buttons are sewn to the garment.

An alternate embodiment of the automatic button feeder is shown in FIGS. 10 through 16. The automatic button feeder is shown generally at 400 in FIGS. 10 and 11 and it should be noted that a substantial portion of the elements comprising automatic button feeder 20 are utilized in automatic button feeder 400.

Figure 10:
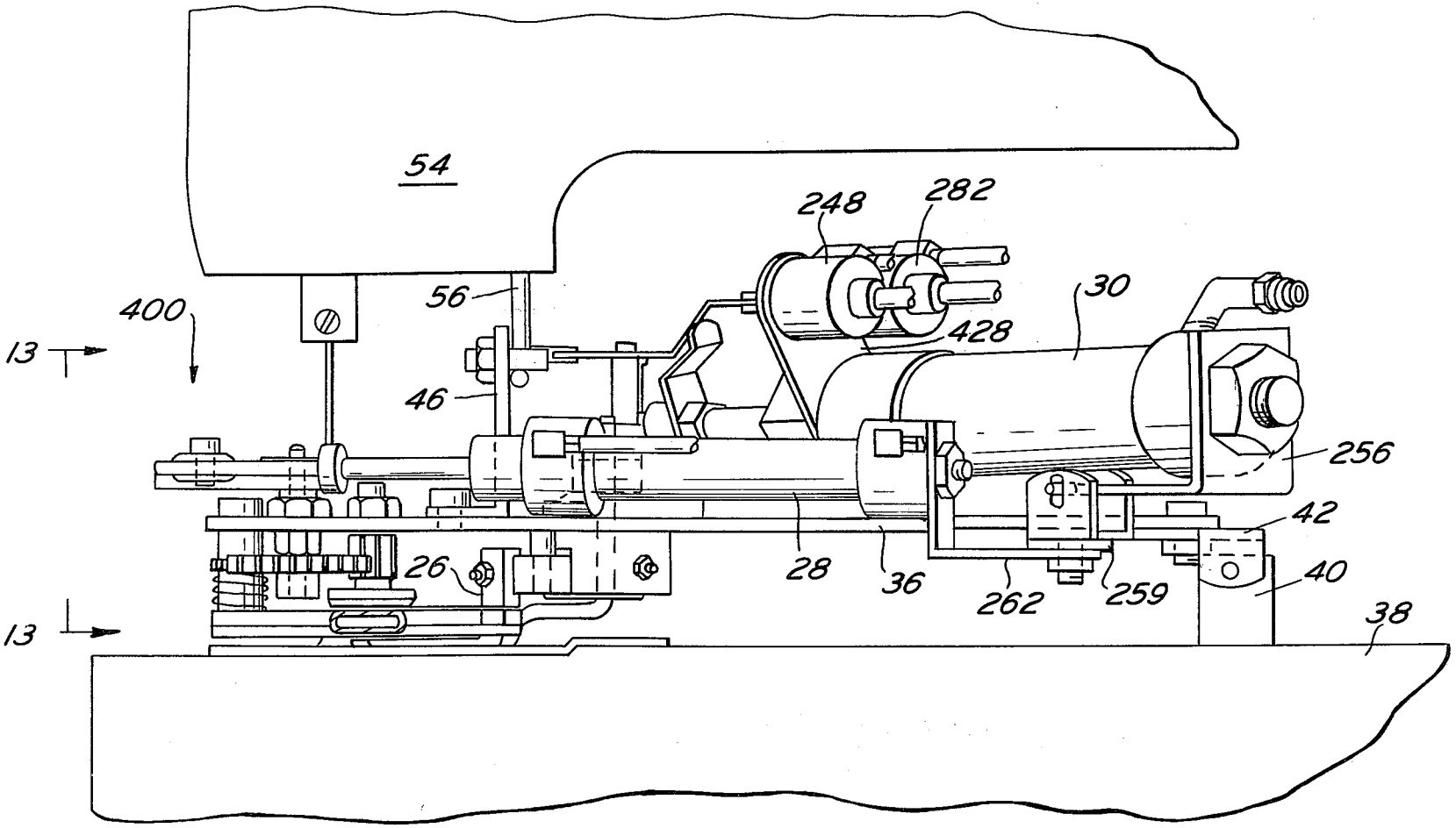
FIG. 10 is a side elevational view of an alternate button feeder embodying the invention for use with a manual placement of garments with an automatic button hole sewing machine.
Figure 11:
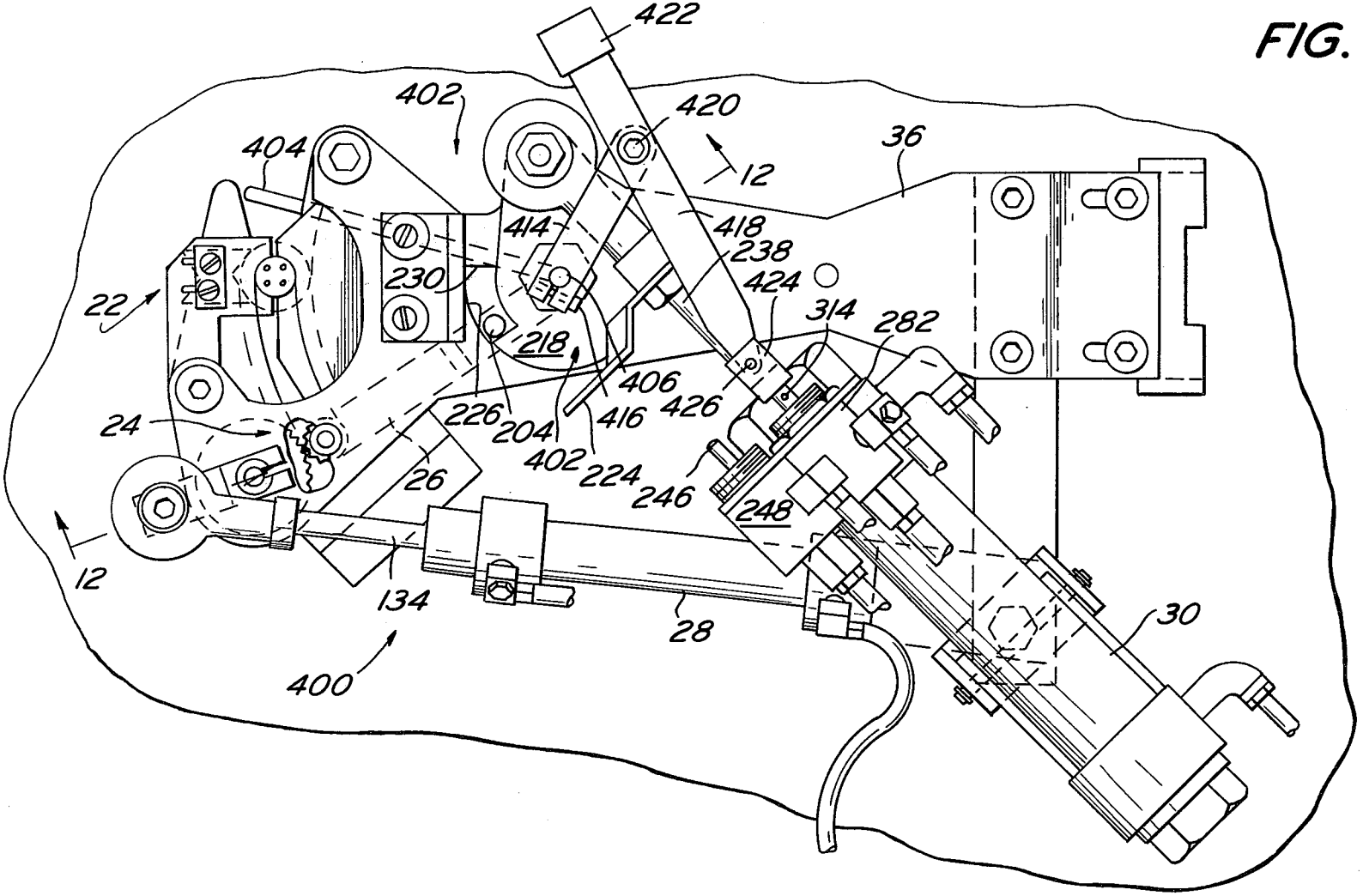
FIG. 11 is an enlarged top plan view of the alternate automatic button feeder embodying the invention.

As seen in FIGS. 10 and 11 the automatic button feeder 400 includes a sewing station 22, an orientation station 24, an injection arm 26, an orientation cylinder 28, an injection cylinder 30 and a main clamp bracket 36. The main clamp bracket 36 is similarly secured to the sewing machine table 38 via a pivotable connection comprised of bracket 40 and 42, as best seen in FIG. 10. Similarly, an L-shaped bracket 46 is provided for support of the other end of the automatic button feeder by the clamp hook 56 which depends from sewing machine head 54.

It should be noted that a thread sensing cylinder is not required in the automatic button feeder 400. Rather, the automatic button feeder 400 includes a thread sensing mechanism 402.

Figure 12:
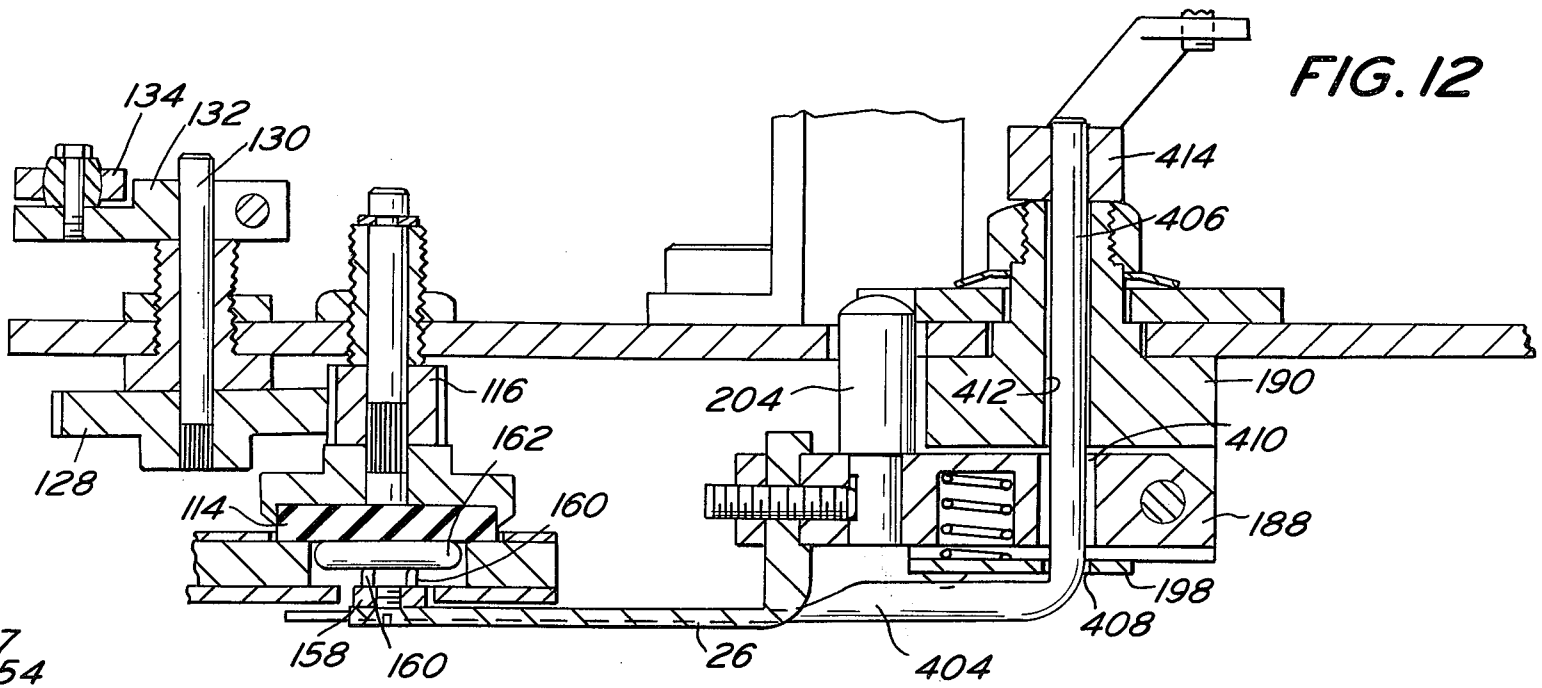
FIG. 12 is an enlarged sectional view taken along the line 12—12 in FIG. 11.

The thread sensing mechanism 402 is best seen in FIGS. 11 and 12 and basically comprises a thread sensing arm 404, which is L-shaped and includes an upwardly projecting leg 406 which extends vertically through an opening 408 in plate 198, a cylindrical vertically extending opening 410 of the arm bracket 188 and the cylindrical bore 412 of the pivot holder 190. Leg 406 is secured at its uppermost end in the opening of a link bar 414. The link bar 414 includes a split end having a threaded fastener 416 extending transversely therethrough for tightening the opening about leg 406 so that the rotation of leg 406 causes rotation of the link bar 414 about the vertical axis through leg 406.

Figure 13:
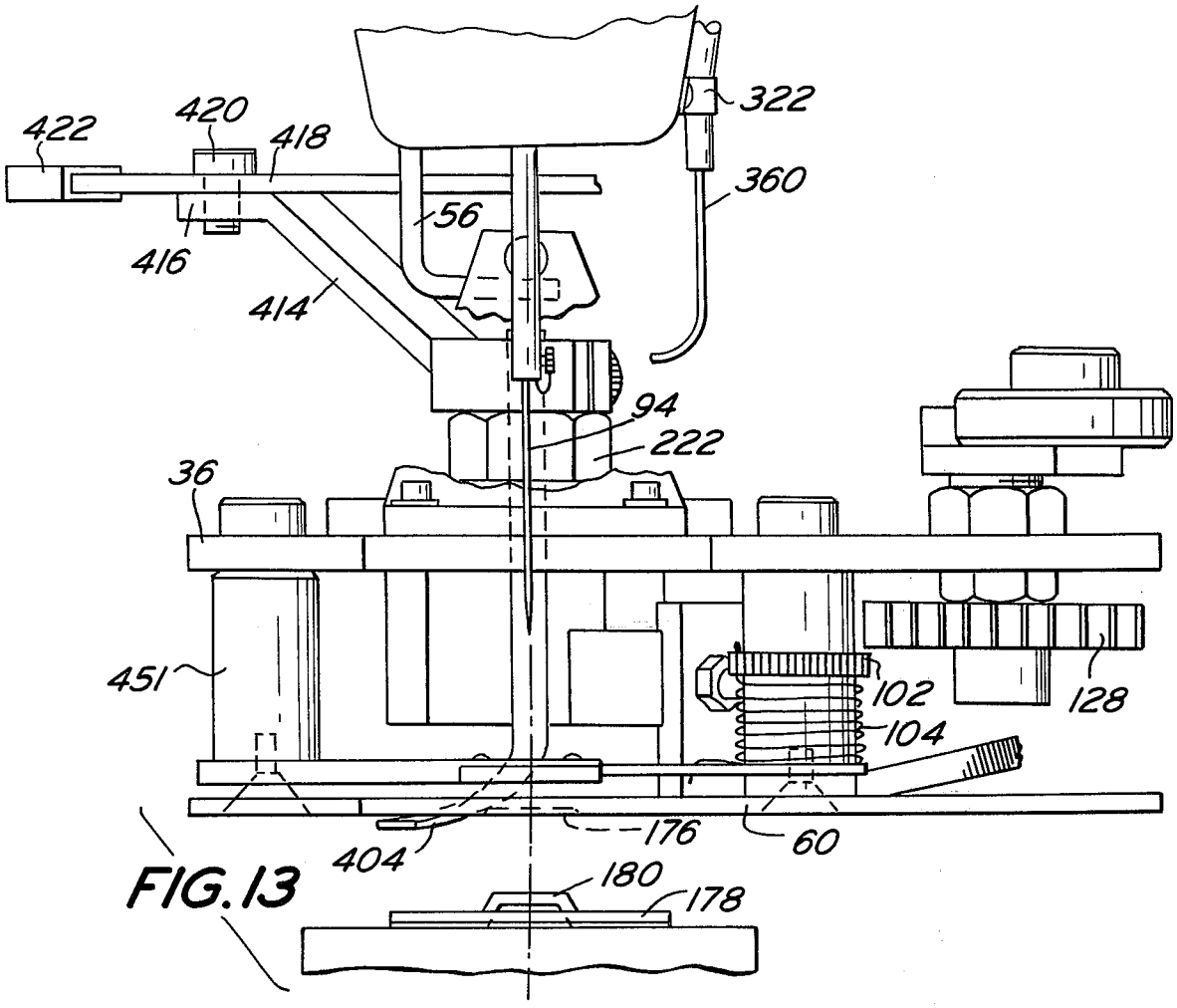
FIG. 13 is an enlarged front elevational view taken along the line 13—13 in FIG. 10.

The link bar 414 as best seen in FIG. 13 extends at an angle upwardly and has a horizontally disposed end 417 which is pivotally connected to a connecting bar 418 by fastener 420. It should be noted that the end of the connecting bar 418 includes a button 422 which is suitably secured to the connecting bar 418 and, as will hereinafter be seen, enables an operator to cause a button to be placed in the sewing station.

As best seen in FIG. 11, the end of the connecting bar 418 is connected to the stem 314 of valve 282 via a connecter 424 which is secured to the stem 314 and includes a pivotable connection to the linking bar 418 by a pin 426 which extends through a slot which causes a split end in the connecter 424.

It should be noted that the valve 282 in the automatic button feeder 400 is mounted adjacent the valve 248 on the orientation cylinder 40. It will be remembered that the valve 282 is provided on the thread sensing cylinder in the automatic button feeder 20 of FIGS. 1 through 9. The valve 248 is mounted along with valve 282 on cylinder 30 by a suitable bracket 428 which is best seen in FIG. 10. The stem of valve 248 is similarly abutted by flange 244 which is connected to the rod 238 of the injection cylinder 30. The flange, however, is mounted at an angular disposition with respect to the location of the flange in the automatic button feeder 20 so that it is aligned with the stem 246 of valve which is mounted slightly spaced from its position on cylinder 30 in the automatic button feeder 20.

Figure 15:
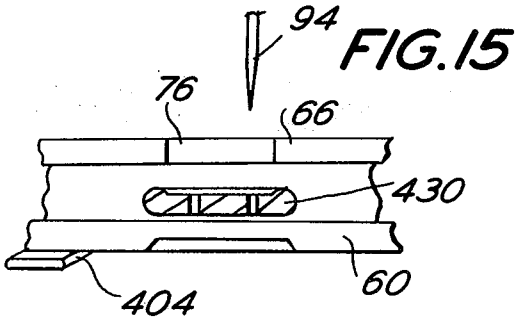
FIG. 15 is an enlarged fragmentary sectional view taken along the line 15—15 in FIG. 14.
Figure 14:
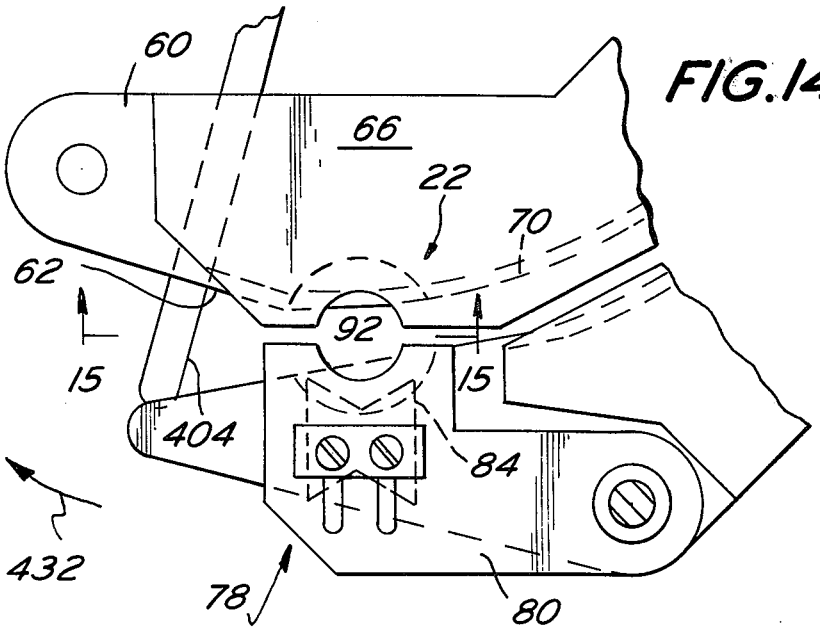
FIG. 14 is an enlarged top plan view of the sewing station of the alternate button feeder.

As best seen in FIGS. 13, 14 and 15, arm 404 is substantially flat at its end and extends below and adjacent the mounting plate 60 laterally adjacent to sewing station 22.

It should be remembered that the clamping bracket 78 acts to hold a button between the button holding block 84 and the spacer plate 70. The button is then directly beneath the opening provided by notches 66 and 92 in plates 66 and 80, respectively. Thus, as seen in FIG. 15, the needle 94 extends through the opening to sew a button which is disposed between the cover plate 66 and the mounting plate 60 to a garment disposed beneath the mounting plate 60. When the button is sewn to the garment, the operator moves the garment with the button sewed thereto to the left as seen in FIG. 14 and thereby causes the arm 404 to be rotated in the direction of arrow 432. Because the arm 404 is closely disposed below the mounting plate 60, there is little likelihood that the button and garment are moved out of the slot 62 which is formed in the plate 60, without moving the arm 404 in the direction of arrow 432. That is, the button rides on the top surface of the mounting plate 60 and thus the thread sewing the button to the garment abuts the arm 404 in order to remove the button and the garment from the sewing station 22.

Each time that the arm 404 is rotated in the direction of arrow 432 as shown in FIG. 14, the linking bar 414 is rotated clock-wise about leg 406 as shown in FIG. 11 thereby causing the connecting bar 418 to depress stem 314 of valve 282. As will hereinafter be seen, the depression of stem 314 causes the injection arm 26 to be moved from the orientation station to the sewing station and provide the next button for the next sewing operation.

Figure 16:
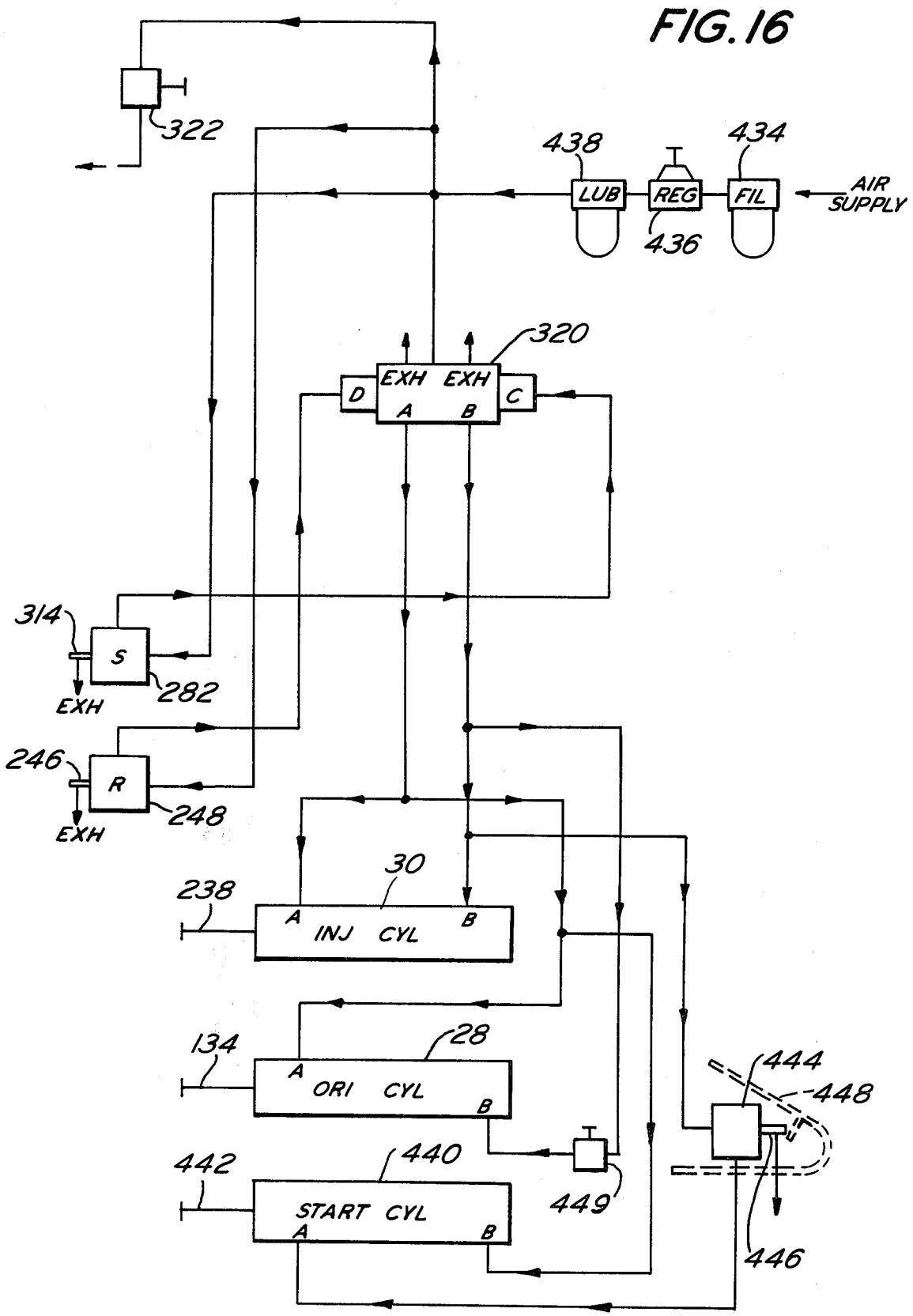
FIG. 16 is a schematic block diagram of the fluid control system for the alternate button feeder.

The control system is shown in FIG. 16 for the automatic button feeder 400. The control system of feeder 400 is also of the fluid logic type and includes a filter 434 which receives the air supply which is preferably at 75 psi or higher. The output of filter 434 is applied to a regulator 436. The output of the regulator 436 is connected to a lubricator 438.

The air filter, the regulator and the lubricator are provided for the automatic button feeder 400 because it is not used in combination with an indexing system as is feeder 20. In the TEXTOMATIC indexer referred to above, the air pressure is provided by the indexer and is already purified, contains an oil mist and is at the proper pressure. The filter 434 is provided to remove dirt and moisture from the air supply and therefore purify the air which enters the fluid logic system. The regulator 436 regulates the pressure of the air so that the air entering the system is provided at 60 psi. The lubricator 438 is provided in order to lubricate the entire system by providing an oil mist within the air.

The output of the lubricator 438 is connected to the input of the four way double pilot valve 320. The output of the lubricator is also connected to the bleeder valve 322 and to the R valve 248. In addition, the output of the lubricator is connected to the input of the S valve 282. The output of the bleeder valve 322 is utilized to separate the thread from the garment. The output of the R valve 248 is connected to pilot D of valve 320. The output of S valve 282 is connected to pilot C of valve 320.

Port A of valve 320 is connected to the A input of the injection cylinder and to the A input of the orientation cylinder 28. In addition, the A output of valve 320 is connected to the B input of a start cylinder 440.

The start cylinder 440 includes a rod 442 which is connected to a start button on the automatic sewing machine which starts the sewing operation each time the rod 442 is moved into the start cylinder port 40. Port B of the valve 320 is connected to the B input of the injection cylinder 30 and an input to valve 444 and to the B input of orientation cylinder 28 via a flow regulator 449. The valve 444 includes stem 446 and is mounted so that it is actuated by a foot pedal 448 which is shown in phantom in FIG. 16. The output of valve 444 is connected to the A input of the start cylinder 440.

In operation, the four way double pilot valve 320 normally has the air flowing from the input to the B port output. The four way double pilot valve follows the injection cylinder 30 and thus the injection cylinder which controls the injection arm causes the pilot valve 320 to be in its position with the B port open whenever the injection arm is at the orientation station. The start valve 444 receives air only when the input to the four way double pilot valve 320 is exited via the port. B. Thus, if an operator intends to push the foot pedal 448 to cause a sewing of the button while the injection arm is not at the orientation station, no air is supplied to the valve 444. Therefore, no air pressure can be applied to the A input of the start cylinder 440 by the opening of valve 444. When the injection arm is beneath the orientation station, the sewing machine can be started by pressing the foot pedal 448 which causes the depression of the stem 446 to valve 444 and causes an opening of the flow of air through valve 444 and thereby causes the rod 442 to be moved within start cylinder 440.

After the sewing operation of the machine has been completed, the operator then moves the garment with the sewn button out of the sewing station and thereby causes the thread sensing arm 404 to be rotated which causes the depression of stem 314 of valve 282. When the valve stem 314 is depressed, valve 282 is opened, thereby causing pressure to be applied to pilot C of valve 320 and thereby causing the air to be rerouted to port A of valve 320 and causing the injection cylinder 30 to move the rod 236 inwardly thereof.

The injection arm is moved to the sewing station and thereby deposits a button at the sewing station whereupon the injection arm is lowered out of the button after it reaches the sewing station. That is, as the rod 238, as seen in FIG. 11, is drawn into the injection cylinder 30, the lift disc 218 is rotated clock-wise thereby causing pin 204 to be moved against wall 230 of slot 226. When pin 204 reaches wall 230 the lift pin 204 is stopped insofar as its lateral traverse is concerned and thereby leaves the injection arm 26 directly at the sewing station 22.

As the rod 238 continues its movement into cylinder 30, the disc 218 continues to rotate and thereby rides over the top surface of pin 204 and causes the pin 204 to be lowered and thereby causes the injection arm 26 as seen in FIG. 12 to be lowered. Rod 442 of the start cylinder 440 was returned to its original position when the A port of valve 320 was opened. As soon as the flange 244 on the rod 238 reaches the stem 246 of valve 248 and depresses the same, the R valve 248 is opened thereby causing air to be supplied to pilot D of valve 320.

The air flow is shifted to port B of valve 320 thereby providing air pressure to the B port of both the injection cylinder 30 and the orientation cylinder 28. The rod 238 is moved out of the injection cylinder and thereby causes a counter clock-wise rotation of lift disc 218 as shown in FIG. 11. The counter clock-wise rotation of the lift disc 218 causes the rotation of pin 204 which is lodged thereunder and causes the injection arm 26 to be returned to the position below the orientation station. As the lift disc 218 continues to rotate, the bottom surface of the lift disc 218 rises off of the pin 204 thereby allowing the injection arm 26 to rise as shown in FIG. 12 thereby causing the pins 160 to be urged against the bottom surface of button 162.

It should be noted that at the same time that the injection cylinder receives air at input B, the orientation cylinder 28 receives the air at input B via flow regulator 449 thereby causing the emitting of rod 134 of the orientation cylinder 28. The emitting of rod 134 causes the rotation of link 132 which causes the rotation of post 130 which in turn causes the rotation of gear 128. The 90° rotation of gear 128 causes a complete rotation of the pinion 116 which rotates the pad 114 and thereby causes the button 162 to rotate as the pins 160 urge the button 162 to rotate as the pins 160 urge the button against the pad. As soon as the openings in the button 162 align with pins 160, the button drops on the pin and thereby prevents any further rotation of the button.

The injection cylinder 30 is thus in the rest position with the injection arm 26 located at the orientation station with the orientation cylinder also at its rest position. The pilot valve remains open to the B port and thereby enables the starting valve 444 to be opened to pass air to the start cylinder 440 upon the next depression of the foot pedal 448. As soon as the foot pedal 448 is pressed, thereby depressing the stem 446, the valve 444 starts the operation of the sewing machine which fastens the next button to the garment. When the garment is moved again by an operator and the sensing arm 404 is rotated about leg 406 thereof, the cycle is repeated.

The button 422 enables the operator to inject a button to the sewing station by pressing button 422. This causes stem 314 of S valve 282 to be depressed which also starts a logic sequence resulting in moving a button from the orientation station to the sewing station.

It should be noted that except as otherwise stated the button feeder 400 includes parts like those of the button feeder 20. The removal of thread sensor 34 and substitution of sensor 402 in feeder 400 also requires a post 451 (FIG. 13) which extends between the main clamp bracket 36 and mounting plate 60.

It should be noted that both the automatic button feeder 20 and the automatic button feeder 400 have been shown for use in combination with a sewing machine of the automatic type wherein a spring is provided which causes the main clamp bracket to be moved downwardly so that the button is pressed against the top of a garment. After the sewing operation has been completed by the machine, the clamp lifting hook, which is also provided with the automatic sewing machine, causes the main clamp bracket to be lifted and thereby causes the entire assembly to be moved off the garment so that the garment can be moved out of the sewing machine or into the case of the automatic garment indexer, the garment can be moved by the indexing apparatus for the next sewing operation.

It is contemplated that a sewing machine which is not automatic can be adapted for use with the automatic button feeders 20 and 400 by the use of appropriate fluid logic and mechanical linkage for lifting the main clamp bracket 36 of the automatic button feeders at the end of the sewing cycle and lowering the main clamp bracket at the beginning of a sewing cycle.

The main clamp bracket 36 is dimensioned so that a single button size can be fed thereby, however, it should be noted that the automatic button feeder embodying the invention enables different sizes of buttons to be automatically fed to a sewing machine by a simple replacement of the main clamp bracket. That is, in automatic button feeder 20, the entire main clamp bracket 36 and the assemblies attached thereto are removable from the pneumatic control system by merely removing fasteners 45 from the hinge formed of brackets 42 and 40, fastener 138 and fastener 240 and split spring 294. The fasteners 138 and 240 when removed disconnect the connectors of cylinders 28 and 30 from the orientation means and the injections means, respectively. Removal of rod 286 from linking rod 292 is enabled by the removal of the split spring 294.

When each of these fasteners is removed, the main clamp bracket is removed and a main clamp bracket of similar construction, but being suitably dimensioned for a different size button is replaced therefor. This enables an entire assembly to be connected to the pneumatic control and movement system by replacement of the aforesaid fasteners. The necessity of making adjustments to the track size and the clamping means of the new clamp bracket assembly until the system operates correctly with the new size button is eliminated. The simple disconnection of one clamp bracket and the connection of another is all that is necessary to accomplish this result.

With the respect to automatic button feeder 400, it is necessary only that fasteners 45 to the hinge be removed along with the fasteners 138 and 240 for the connectors of cylinders 28 and 20 and the threaded fastener (not seen) for securing connectors 424 to stem 314 of valve 282. By removing these fasteners, the entire assembly connected to the clamp bracket 36 is removed and a similar assembly which is different only in the dimension of the clamp bracket is replaced therefor with the same results as in the automatic button feeder 20.

In both automatic button feeder 20 and 400, the securement of the new clamp bracket 36 with the orientation station of the new clamp bracket 36 with the orientation station and securing station provided therein prevents undue wear on any one part and thereby prolongs the life of each clamp bracket and the assembly secured thereto.

It can therefore be seen that the clamp bracket 36 and the assembly secured thereto are removable from the control portion of the automatic feeder 20 and 400. That is, the clamp bracket is removable from the pneumatic cylinders 28, 30 and 32 in feeder 20 and from the pneumatic cylinder 28, pneumatic cylinder 30 and the stem of valve 282 in automatic button feeder 400.

It can therefore be seen that a new and improved automatic button feeder embodying the invention has been provided. It should be recognized that various features have general application, such as the automatic thread sensor which can be used for sensing the affixing or placement of other garment fasteners such as snaps which can also be placed automatically or garments by an indexing machine. In addition, the injecting mechanism can also be utilized for feeding fasteners other than buttons where alignment of the fastener is required.

The automatic button feeder embodying the invention provides positive delivery of buttons despite the irregularities of buttons as to their thickness and diameter. The means for alignment of the buttons with respect to the sewing machine prevents scratching of the buttons by use of a cushion contact with the uppermost surface for orienting the button with respect to an injection arm which delivers the button with respect to an injection arm which delivers the button to the sewing station in the proper orientation.

The automatic button feeder also utilizes efficiency of pneumatic components which are compatible with fluid logic control of the system.

It should be noted that the automatic button feeder 20 prevents considerable waste when using an automatic indexing operation for the sewing of buttons to a garment. That is, the sensing means utilized therein prevents the indexer from moving a garment unless a button has been sewn properly to a garment. In prior systems, where a thread has broken and the button has not been sewn properly to the garment, the garment is continuously moved along with the buttons moved out of the sewing station and falling off the garment.

Not only does the garment have to be repaired by the replacement of buttons through a non-automatic operation, but also, the buttons are lost requiring a replacement thereof. In the instant system the automatic indexing is immediately stopped by the failure of the thread sensor to contact thread between the button and the garment after the sewing cycle for a button has been completed.

In the automatic button feeder 400, where the garment is moved by an operator after each button has been sewn, if the thread in the sewing machine has broken, the button cannot be removed from the button clamp at the sewing station until it has been sewn to a garment. Thus, buttons are not lost as the garment is removed from the sewing station since the button is tightly held in the clamp until it has been secured to a garment. Moreover, the button cannot be moved out by the insertion of the next button into the sewing station because of the fact that the sensor finger has not been activated and it therefore prevents the injection of the next button.

Without further elaboration, the foregoing will so fully illustrate my invention that others may, be applying current or future knowledge, readily adapt the same for use under various conditions of service.

What is claimed as the invention is:

1. An automatic button feeder comprising a first station for receiving buttons in sequence and including orientation means, a second station at which a button is sewn and an injection member for moving the button from said orientation station to the sewing station, said injection member including alignment pins which are used in combination with orientation means which align the openings of the buttons with the alignment pins, said feeder also including means for moving the injection member which draws the pins of the member under said first station, the openings of said button are aligned with the pins by said orientation means, said member remains stationary after the button has been aligned until a button at said second station has been removed therefrom.

2. The automatic button feeder of claim 1 wherein said second station includes clamp means for holding said button until said button is secured to said garment and said garment is removed from said station.

3. The automatic button feeder of claim 1 wherein a button at said first station is moved to said second station by the pins of said injection member in said openings in said button, said injection member having its lateral movement stopped at said second station whereupon said injection member is lowered so that said pins are removed from said button.

4. The automatic button feeder of claim 3 wherein said injection member is moved from said second station to said first station in said lowered position and the movement of said member is terminated with said member directly below said first station, said member spring urged upwardly against a button at said first station which was provided thereat while said previous button was moved to said second station.

5. The automatic button feeder of claim 4 wherein said orientation means includes a rotatable cushion, said rotatable cushion causing said button to rotate until said openings of said button are aligned with said pins of said injection member so that said button is properly oriented for placement in said second station for automatic sewing of said button to said garment.

6. The automatic button feeder of claim 1 wherein said injection member comprises an elongated arm which is rotatable about one end thereof and having said pins located at the other end thereof.

7. The automatic button feeder of claim 1 wherein said means for moving said injection means comprises an hydraulic cylinder.

8. The automatic button feeder of claim 7 wherein the rod of said hydraulic cylinder is connected to a rotatable disc and said arm is pivoted by said disc.

9. The automatic button feeder of claim 8 wherein said arm is pivotably supported by a holder about a horizontal axis, said holder including means for spring urging said arm upwardly and further including a pin which extends through an arcuate slot in a fixed bracket, the ends of said slot fixing the limits of lateral travel of said pin for controlling the extent of movement of said arm.

10. The automatic button feeder of claim 9 wherein said disc includes a shoulder for engaging said pin for moving said arm from said first station to said second station, said disc overriding said pin when said pin abuts the end of said slot thereby lowering said pin and thereby causing said arm to be lowered by pivoting about said horizontally disposed axis.

11. The automatic button feeder of claim 10 wherein said disc includes a detent in its lowermost surface for engaging said pin after it rides over said pin, said disc being rotated by said hydraulic member in the opposite direction for returning said arm to said first station by drawing said pin as said disc rotates in the opposite direction, said disc riding off the end of said pin when said pin abuts the other end of said slot, thereby allowing the pin and the arm connected thereto to rise and thereby be spring urged against said button at said first station.

12. The automatic button feeder of claim 5 wherein said cushion is rotated by a second hydraulic cylinder, the rod of which is connected to a rotatable member connected to said cushion.

13. The automatic button feeder of claim 1 and further including sensing means adjacent said second station for determining whether said button has been sewn to said garment, said sensing means including an elongated finger and means for moving said finger, said finger being disposed immediately below said button and said means for moving causing said finger to be directed beneath said button after a sewing cycle has been completed and means responsive to said finger for indicating whether said button has been sewn if the movement of said finger below said button is interrupted by the thread securing said button to said garment.

14. The automatic button feeder of claim 1 and further including sensing means adjacent said second station for determining whether said button has been sewn to said garment, said sensing means including an elongated finger, said second station being disposed at the end of a track within which a button travels from said first station to said second station, said finger preventing the removal of said button from said track without abutting said finger when said button is sewn to said garment, and means responsive to movement of said finger for causing said injection member to move a button from said first station to said second station.

15. For use with an automatic garment indexer, means for affixing a garment fastener to a garment, sensing means adjacent the location that said garment fastener is affixed to said garment for determining whether said garment fastener has been affixed to said garment, said sensing means including an elongated finger and means for moving said finger, said finger being disposed immediately below said fastener and said means for moving causing said finger to be directed beneath said fastener after said means for affixing has completed an affixation cycle, and means responsive to said finger for indicating that said garment fastener has been affixed if the movement of said finger is interrupted by the securement of said garment fastener to said garment.

16. The sensing means of claim 15 wherein said means for moving comprises an hydraulic cylinder.

17. The sensing means of claim 16 wherein said finger is connected to the rod of said hydraulic cylinder so that movement of said rod causes movement of said elongated finger.

18. The sensing means of claim 17 wherein said finger is secured to a lever which is pivotable centrally about a vertical axis, said lever being pivotally connected at one end to the rod of said cylinder and at its other end is fixedly secured to said finger.

19. The sensing means of claim 18 wherein the rod of said cylinder is normally in its innermost position with respect to the cylinder and said rod is emitted when said finger is directed towards said garment fastener, the longitudinal axis of said rod with respect to the longitudinal axis of said lever being substantially greater than 90°.

20. The sensing means of claim 19 wherein said cylinder is mounted so that it is movable along its longitudinal axis and includes a switching means at the end thereof opposite that of the rod, said switching means including a pressure responsive member which is abutted when said finger is interrupted by a secured garment fastener.

21. The sensing means of claim 20 wherein said switching means comprises a valve and said pressure responsive member comprises a stem which opens said valve when depressed by abutment.

22. The sensing means of claim 15 wherein said fastener is a button and said finger senses the thread which secures said button to a garment when said button is properly secured thereto.

23. An automatic button feeder comprising a main bracket having a first station for receiving buttons in sequence and a sewing station at which a button is sewn and an injection member for moving the button from the first station to the said sewing station, said automatic button feeder further including control means for moving said injection member, said control means being removably secured to said bracket with said main bracket being removable as a single unit, said main bracket being dimensioned to receive a single size of buttons so that a different bracket of similar construction which is suitably dimensioned for a different size of buttons can be substituted for said first named main bracket by connecting the same to said control means after said first named main bracket is removed.

24. The automatic button feeder of claim 23 wherein said control means includes a pneumatic cylinder for moving said injection member, said cylinder being secured to said injection member by a removable fastener.

25. The automatic button feeder of claim 24 wherein said first station includes orientation means and said control means includes a pneumatic cylinder for moving said orientation means, said pneumatic cylinder being secured to said orientation means by a removable fastener.

26. An automatic button feeder comprising a main bracket having a first station for receiving buttons in sequence and a sewing station at which a button is sewn and an injection member for moving the button from the first station to the said sewing station, said automatic button feeder further including control means for moving said injection member, said control means being removably secured to said bracket, said main bracket being dimensioned to receive a single size of buttons so that a different bracket of similar construction which is suitably dimensioned for a different size of buttons can be substituted for said first named main bracket by connecting the same to said control means after said first named main bracket is removed, said brackets each including a member for sensing the securement by a fastener to a garment and said control means includes means responsive to said sensing means, said means responsive being secured to said sensing means by a removable fastener.

* * * * *